US005260716A

United States Patent [19]

Maslanka

[11] Patent Number: 5,260,716

[45] Date of Patent: Nov. 9, 1993

[54] APPARATUS AND METHOD FOR THERMAL PRINTING WHEREIN DONOR SLACK IS CONTROLLED BY A CAPSTAN ROLLER

[75] Inventor: Daniel C. Maslanka, Rochester, N.Y.

[73] Assignee: Eastman Kodak Company, Rochester, N.Y.

[21] Appl. No.: 905,701

[22] Filed: Jun. 29, 1992

[51] Int. Cl.[5] ..... B41J 2/32

[52] U.S. Cl. ..... 346/76 PH; 400/235; 400/235.1; 400/232

[58] Field of Search ..... 346/76 PH; 400/120, 400/235, 235.1, 232

[56] References Cited

U.S. PATENT DOCUMENTS

| | | | |
|---|---|---|---|
| 4,458,253 | 7/1984 | Goff, Jr. et al. | 346/76 PH |
| 4,480,933 | 11/1984 | Shibayama et al. | 346/120 |
| 4,577,199 | 3/1986 | Saiki et al. | 346/76 PH |
| 4,772,144 | 9/1988 | Weed | 400/235.1 |
| 4,774,525 | 9/1988 | Mitsushima et al. | 346/76 PH |
| 4,860,030 | 8/1989 | Pond et al. | 346/76 PH |
| 4,918,461 | 4/1990 | Murakami | 346/76 PH |
| 4,972,207 | 11/1990 | Ishiyama et al. | 346/76 PH |
| 4,998,117 | 3/1991 | Shibuya et al. | 346/76 PH |
| 5,041,845 | 8/1991 | Ohkubo et al. | 346/24 |
| 5,117,241 | 5/1992 | Stephenson | 346/76 PH |

FOREIGN PATENT DOCUMENTS

| | | | |
|---|---|---|---|
| 0073984 | 4/1984 | Japan | 400/235.1 |
| 0063187 | 4/1985 | Japan | 400/235.1 |
| 0286785 | 12/1987 | Japan | 400/235.1 |
| 0054276 | 3/1988 | Japan | 400/235.1 |
| 0130180 | 6/1991 | Japan | 400/235 |

OTHER PUBLICATIONS

Molloy et al., "Motor-Driven Ribbon Take-Up", IBM Bulletin, vol. 27, No. 1B, Jun. 1984, pp. 900-901.

*Primary Examiner*—Benjamin R. Fuller
*Assistant Examiner*—Huan Tran
*Attorney, Agent, or Firm*—Milton S. Sales

[57] ABSTRACT

A thermal printer has a rotatably mounted supply spool, and a rotatably driven print drum for unwinding a dye donor web from the supply spool and advancing the web past a thermal print head at a print zone where dye is transferred to a print receiving medium by the print head. The print drum causes the supply spool to rotate as it unwinds web therefrom and further causes the web to be paid out of the print zone at a constant rate. A rotatably mounted take-up spool accumulates web paid out of the print zone and tensions the web. A capstan roller is interposed between the print drum and the take-up spool. The capstan roller drivingly engages the web and controllably advances the web towards the take-up spool as the web is paid out of the print zone. The capstan roller advances the web at a slower rate than the web is paid out of the print zone to eliminate tension on the donor web caused by the take-up spool as the donor web exits the print zone. Tension may also be eliminated by delaying operation of the capstan roller to allow a small amount of slack to accumulate in the web.

5 Claims, 1 Drawing Sheet

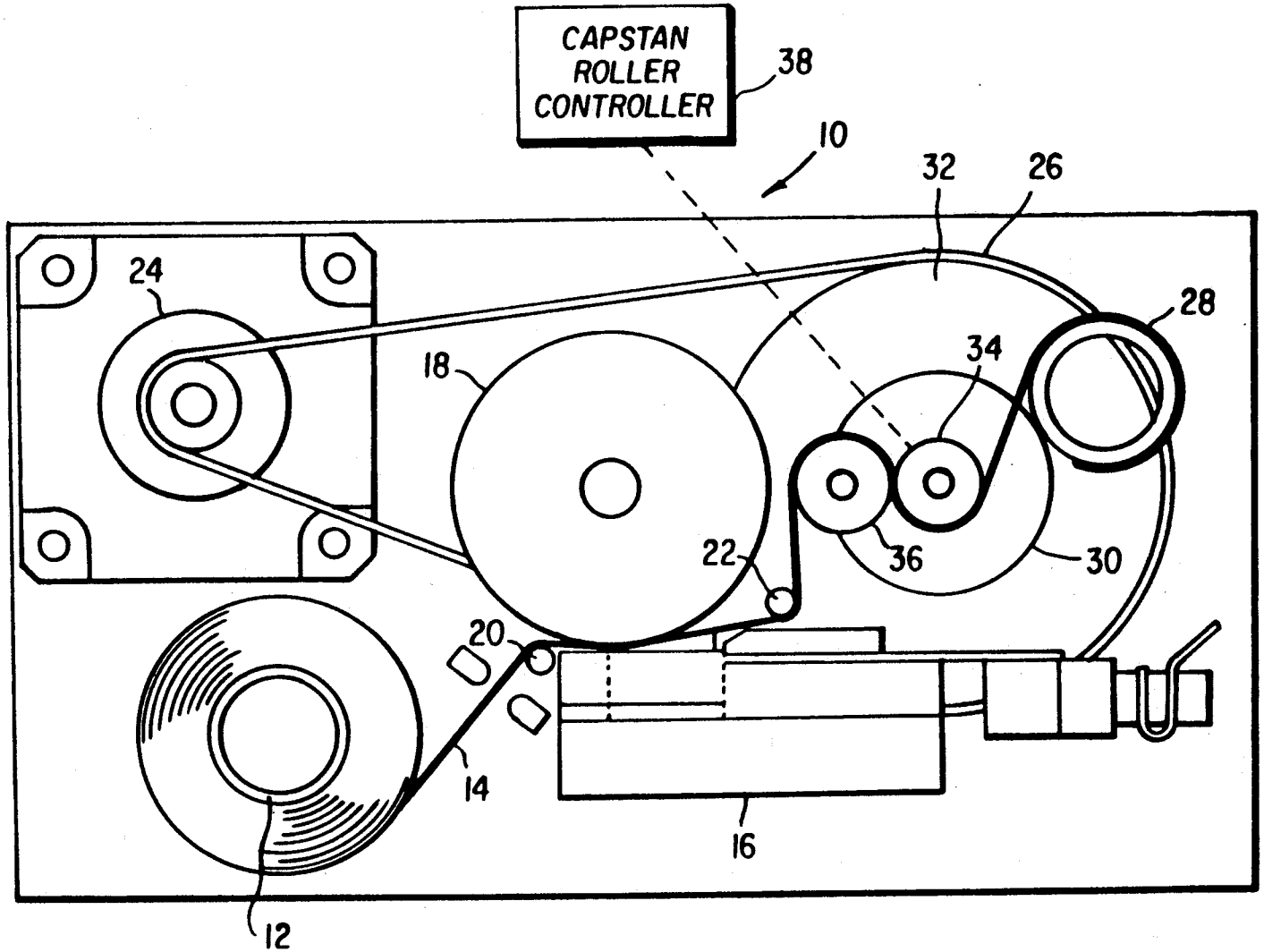
CAPSTAN ROLLER CONTROLLER
38
10
26
32
28
34
30
36
22
18
24
20
14
16
12

APPARATUS AND METHOD FOR THERMAL PRINTING WHEREIN DONOR SLACK IS CONTROLLED BY A CAPSTAN ROLLER

CROSS-REFERENCE TO RELATED APPLICATIONS

This application is related to commonly assigned U.S. patent application Ser. No. 905,700, filed Jun. 29, 1992 by Daniel C. Maslanka and entitled "High Precision Donor Web Positioning Apparatus and Method for a Thermal Printer".

TECHNICAL FIELD

This invention relates generally to an apparatus and method for advancing a donor web in a thermal printer, and, more particularly, to an apparatus and method for eliminating tension on the web caused by the pull of the take-up spool on the donor web as the web exits the print zone.

BACKGROUND OF THE INVENTION

In a thermal printing process, a dye bearing donor web is brought into contact with a dye receiving print media at a print zone. Thermal printing is effected by contacting the donor web with a print head that spans the donor web in a direction transverse to the direction of web travel. To maintain intimate contact between the donor web and receiver during the printing operation, the donor web and print media are partially wrapped around the surface of a print drum. The print drum is commonly driven by a precision stepper motor so that the spacing between adjacent image lines can be precisely controlled. The take-up spool for the donor web is often rotatably driven by a far less expensive DC motor, because its function is simply to accumulate expended donor web. The donor web is supplied by a rotatably mounted supply spool, and a clutching arrangement is used to control the drag on the supply spool to prevent free-wheeling of the supply spool under the influence of the take-up spool motor. Print quality is influenced considerably by tension variations in the donor web during printing. An artifact known as banding can occur when web tension varies. Ideally, the pulling tension exerted by the take-up spool remains uniform throughout the printing cycle. Unfortunately, this ideal is difficult to achieve, especially when relatively inexpensive drive motors are used to effect take-up spool rotation. Also, the diameter of the take-up spool has a variable effect on web tension. As prints are made, the take-up spool diameter gradually increases, thereby altering web tension. Accordingly, it will be appreciated that it would be highly desirable to have a thermal printer wherein print quality is not influenced by the tension exerted by the take-up spool on the donor web.

In commonly assigned application Ser. No. 504,445, there is disclosed a thermal printer in which tension in the donor web downstream of the print zone is reduced to zero during each printing operation. This tensionless condition virtually eliminates the banding artifact and is achieved by rotating the take-up spool at a rate slower than the rate at which the donor web is payed out of the print zone. A two speed motor is used to rotate the take-up spool at two discrete speeds. The first speed is sufficiently slow to produce, during each print cycle, web slack between the print zone and the take-up spool, and the second speed is sufficiently fast to eliminate all web slack between printing cycles. Unfortunately, as the take-up spool accumulates expended donor web, its diameter increases causing the web to be taken up at an ever increasing rate even though the spool rotates at a fixed angular velocity. Accordingly, it will be appreciated that it would be highly desirable to have a thermal printer wherein print quality is not influenced by the diameter of the take-up spool.

Commonly assigned application Ser. No. 542,502 discloses a thermal printer wherein the take-up spool rotates at a speed proportional to the approximate instantaneous diameter of the take-up spool. A signal proportional to the instantaneous diameter is produced by a shaft encoder to monitor the angular velocity of the supply spool from which the donor web is unwound and fed to the print zone. A variable speed motor, operatively coupled to the take-up spool, is responsive to such signal to rotate the spool at a rate equal to or slightly slower than the rate at which expended donor web is paid out of the print zone during the printing operation. Unfortunately, a shaft encoder and other components are required that increase the cost of the printer. Accordingly, it will be appreciated that it would be highly desirable to have a thermal printer that has zero tension on the donor web but does not require components which increase the cost of the printer.

A donor is unwound from the supply spool by the force generated at the nip of the rotating drum and the thermal print head. The peripheral speed of the drum during the print cycle is constant and is equal to the speed of the web during the print cycle. Used donor is typically wound onto the take-up spool by a motor/-transmission assembly; but, because the donor supply and take-up spool diameters change as donor is wound and unwound, their respective angular velocities must change correspondingly to maintain equilibrium. These motor/transmission assemblies are designed so that the angular velocity will be greater than or equal to that required to rewind the donor at its smallest take-up spool diameter. As more donor is wound onto the take-up spool, less speed is required. The speed change is usually accomplished with a slip clutch inserted between the motor and the spool. The force added by the slip clutch will add a force component that may compromise the integrity of the dye transfer process, manifesting itself as bands of uneven density across the printed page, commonly referred to as banding. Accordingly, it will be appreciated that it would be highly desirable to have a thermal printing apparatus and method that provides zero tension on the donor web to eliminate banding, but which is simple and inexpensive.

SUMMARY OF THE INVENTION

The present invention is directed to overcoming one or more of the problems set forth above. Briefly summarized, according to one aspect of the present invention, a thermal printer has a rotatably mounted supply spool, and a rotatably driven print drum for unwinding a dye donor web from the supply spool and advancing the web past a thermal print head at a print zone where dye is transferred to a print receiving medium by the print head. The print drum causes the supply spool to rotate as it unwinds web therefrom and further causes the web to be paid out of the print zone at a constant rate. A rotatably mounted take-up spool accumulates web paid out of the print zone. A capstan roller is interposed between the print drum and the take-up spool. The capstan roller drivingly engages the web and controllably advances the web towards the supply spool as the web is paid out of the print zone. The capstan roller advances the web at a slower rate than the web is paid out of the print zone to eliminate tension on the donor web caused by the take-up spool as the donor web exits the print zone. Tension may also be eliminated by delaying operation of the capstan roller to allow a small amount of slack to accumulate in the web.

According to another aspect of the present invention, a method for producing thermal prints comprises the steps of unwinding a dye bearing donor web from a rotating supply spool and advancing the donor web to a print zone at which the web is acted upon by a thermal print head and print drum to transfer dye from the web to a print receiving medium, advancing the donor web from the print zone toward a take-up spool by controllably rotating the print drum by a motor means, winding up the advanced donor web on the take-up spool by rotatably driving the take-up spool by the motor means, interposing a capstan roller between the print drum and the take-up spool, and drivingly engaging the donor web and controllably advancing the donor web towards the supply spool as the web is paid out of the print zone to thereby eliminate tension on the donor web caused by the take-up spool as the donor web exits the print zone. The method may include advancing the web with the capstan roller at a slower rate than the web is paid out of the print zone. The method may include delaying operation of the capstan roller and advancing the web with the capstan roller at the same rate as the web is paid out of the print zone.

These and other aspects, objects, features and advantages of the present invention will be more clearly understood and appreciated from a review of the following detailed description of the preferred embodiment and appended claims, and by reference to the accompanying drawing.

BRIEF DESCRIPTION OF THE DRAWING

The drawing is a diagrammatical longitudinal cross-sectional view of a preferred embodiment of a thermal printer illustrating dye donor web drive components in accordance with the present invention.

DETAILED DESCRIPTION OF THE PREFERRED EMBODIMENT

Referring to the drawing, a thermal printer 10 has a donor supply spool 12 supporting a dye bearing donor web 14. The supply spool 12 is rotatably mounted in the printer 10 and rotates as the donor web 14 is unwound. A slip clutch (not shown) prevents free-wheeling on the donor supply spool 12 so that the donor web 14 is unwound in a controlled manner.

Printing occurs at a printing section of the printer 10 wherein a thermal printing head 16 presses the dye donor web 14 and a dye receiving member against a print drum 18 for transferring dye from the donor 14 to the receiver. The print head 16 is movable between a printing position and a nonprinting position. At the printing position, the print head 16 presses the donor 14 and receiver against the drum 18 for printing, and, at the nonprinting position, the thermal head 16 is spaced from the print drum 18 so that it does not interfere with the travel of the web 14. The contact area of the drum 18 with the print head 16 through the media 14 is called the nip or print zone. Dye donor 14 entering the print zone passes over a guide roller 20, and passes over another guide roller 22 as it exits the print zone. The guiding roller 20 serves to hold the donor 14 away from the print head 16 in the nonprinting position while the guide roller 22 holds the donor 14 away from the print drum 18 as the web 14 exits the print zone.

The print drum 18 is rotatably driven by a motor, such as stepper motor 24, for example. The drum 18 may be directly driven by the stepper motor 24 or may be driven by means of a belt 26, depending on the space allocation of the thermal printer 10. The driven print drum 18 unwinds donor 14 from the supply spool 12, and advances the web 14 past the print head 16 in the print zone where dye transfer occurs. Because the rate of travel of the web 14 is constant in the print zone during printing, the rotatably driven print drum 18 causes the supply spool 12 to rotate as it unwinds web 14 therefrom and further causes the web 14 to be paid out of the print zone at a constant rate.

The donor 14 exiting the print zone is taken up by a donor web take-up spool 28. The take-up spool 28 is rotatably mounted and is rotatably driven by a friction drive wheel 30. The drive wheel 30 is driven by a timing wheel 32 that can be driven by the timing belt 26, which, in turn, is driven by the stepper motor 24. The friction drive wheel 30 can be driven by a separate motor, but it is less expensive to use the one motor. Because the connection between the take-up spool 28 and the drive wheel 30 is a friction connection, slip can occur to allow the take-up spool 28 to keep the web 14 tensioned without breaking. Also, because the diameter of the take-up spool 28 increases as it takes up the expended donor 14, the peripheral speed increases, also tending to tension the web 14.

To prevent tension created by the take-up spool 28 from interfering with the printing occurring at the print zone, a driven capstan roller 34 is provided. Preferably, the capstan roller 34 has a cooperating idler roller 36 to receive the web 14 paid out of the print zone before the web 14 is taken up by the take-up spool 28. The capstan roller 34 is precisely driven by a capstan roller control 38 which may be a stepper motor with an electronic control to precisely step the motor and determine when the motor is to step the roller 34.

Operation of the present invention is believed to be apparent from the foregoing description, but a few words will be added for emphasis. As printing occurs in the print zone, the print drum 18 advances the donor 14 at a controlled constant rate for uniform printing. Because printing at the print zone occurs at a constant rate, the used donor 14 is paid out of the print zone at a constant rate also. Spent donor 14 is metered by the capstan roller 34 and taken up by the take-up spool 28. The capstan roller 34 meters the donor 14 it receives from the print zone so that the donor 14 is taken up by the take-up spool 28 without tension in the print zone. This is accomplished by driving the capstan roller 34 so that the web 14 is metered thereby at a slower rate than it is paid out of the print zone. This creates a small amount of slack in the web 14 between the capstan roller 34 and the print zone. Alternatively, the capstan roller 34 can be driven at a rate such that the donor web 14 is driven at the same rate that it is paid out of the print zone. When this is done, the capstan roller controller 38 delays operation of the roller 34 for a brief interval of time so that slack can accumulate in the web 14 downstream of the print zone and upstream of the roller 34, preferably upstream of the idler roller 22.

It can now be appreciated that there has been presented a thermal printer 10 with a capstan roller 34 that eliminates the force component generated by the friction drive wheel 30 acting on the donor take-up spool 28. The capstan roller 34 can be used advantageously by choosing an appropriate operational speed such that the donor 14 can be paid out of the print zone with a small amount of slack, thereby eliminating the unwanted tension applied by the take-up spool 28. The tensionless take-up of the donor web can be accomplished in two ways. One way is to select a donor drive speed that is slightly slower than the donor pay out speed of the drum 18. With this operational method, the amount of donor slack slowly increases from the start of the printing interval to the end of the printing interval, but is not too great to be conveniently handled by the printer. A second way is to exactly match the donor speed at the capstan with the donor pay out speed of the drum, but not turn on the capstan drive until shortly after the printing operation has started. This causes a small amount of slack to accumulate immediately, but when the capstan roller is energized, the slack remains constant until the end of the printing.

It can now be appreciated that there has been presented a thermal printer that has a rotatably mounted supply spool, and a rotatably driven print drum for unwinding a dye donor web from the supply spool and advancing the web past a thermal print head at a print zone where dye is transferred to a print receiving medium by the print head. The print drum causes the supply spool to rotate as it unwinds web therefrom and further causes the web to be paid out of the print zone at a constant rate. A rotatably mounted take-up spool accumulates web paid out of the print zone and tensions the web. A capstan roller is interposed between the print drum and the take-up spool that drivingly engages the web and controllably advances the web towards the supply spool as the web is paid out of the print zone. The capstan roller advances the web at a slower rate than the web is paid out of the print zone to eliminate tension on the donor web caused by the take-up spool as the donor web exits the print zone. Tension may also be eliminated by delaying operation of the capstan roller to allow a small amount of slack to accumulate in the web.

It can also be appreciated that there has been presented a method for producing thermal prints which comprises the steps of unwinding a dye bearing donor web from a rotating supply spool and advancing such donor web to a print zone at which such web is acted upon by a thermal print head and print drum to transfer dye from the web to a print receiving medium, advancing such donor web from the print zone toward a take-up spool by controllably rotating the print drum by a motor means, winding up the advanced donor web on the take-up spool by rotatably driving the take-up spool by the motor means, interposing the capstan roller between the print drum and the take-up spool, and drivingly engaging the donor web and controllably advancing the donor web towards the take-up spool as the web is paid out of the print zone to thereby eliminate tension on the donor web caused by the take-up spool as the donor web exits the print zone. The method may include advancing the web with the capstan roller at a slower rate than the web is paid out of the print zone. The method may include delaying operation of the capstan roller and advancing the web with the capstan roller at the same rate as the web is paid out of the print zone.

While the invention has been described with particular reference to a preferred embodiment, it will be understood by those skilled in the art that various changes may be made and equivalents may be substituted for elements of the preferred embodiment without departing from invention. For example, instead of a stepper motor in the capstan controller, another precisely controllable motor may be used. In addition, many modifications may be made to adapt a particular situation and material to a teaching of the invention without departing from the essential teachings of the present invention.

The present invention prevents artifacts and print quality is not influenced by the tension exerted by the take-up spool on the donor web. The thermal printer has a donor take-up that exerts zero tension on the donor web as it exits the print zone, but which does not require costly components. The thermal printing apparatus and method provides zero tension on the donor web to eliminate banding, yet is relatively simple and inexpensive. Print quality is not influenced by the diameter of the take-up spool as the diameter of the spool changes during printing because the donor web is tension free.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. Thermal printing apparatus comprising:

a supply spool having thereon a dye bearing donor web;

means for rotatably supporting said supply spool;

a rotatably driven print drum for drivingly engaging said web, unwinding said web from said supply spool and controllably advancing said web past a thermal print head at a print zone where dye is transferred to a print receiving medium by said print head, said rotatably driven print drum causing said supply spool to rotate as it unwinds web therefrom and further causing the web to be paid out of the print zone at a constant rate;

a rotatably mounted take-up spool for accumulating web paid out of said print zone;

motor means for rotating said print drum and said take-up spool and causing said take-up spool to tension said web; and a capstan roller interposed between said print drum and said take-up spool and drivingly engaging said donor web and controllably advancing said donor web towards said take-up spool as said web is paid out of said print zone, said capstan roller advancing said web at a slower rate than said constant rate at which said web is paid out of said print zone to thereby accumulate an amount of slack in said web and eliminate tension on said donor web caused by said take-up spool as said donor web exits said print zone.

2. Thermal printing apparatus comprising:

a supply spool having thereon a dye bearing donor web;

means for rotatably supporting said supply spool;

a rotatably driven print drum for drivingly engaging said donor web, unwinding said web from said supply spool and controllably advancing said web past a thermal print head at a print zone where dye is transferred to a receiving medium by said print head, said rotatably driven print drum causing said supply spool to rotate as it unwinds web therefrom and further causing the web to be paid out of the print zone at a constant rate;

a rotatably mounted take-up spool for accumulating web paid out of said print zone;

motor means for rotating said print drum and said take-up spool and causing said take-up spool to tension said web;

a capstan roller interposed between said print drum and said take-up spool and drivingly engaging said donor web and controllably advancing said donor web towards said take-up spool as said web is paid out of said print zone; and means for delaying operation of said capstan roller to accumulate an amount of slack in said web and thereafter advancing said web at the constant rate that said web is paid out of said print zone to thereby eliminate tension on said donor web caused by said take-up spool as said donor web exits said print zone.

3. A method for producing a thermal print comprising the steps of:

unwinding dye bearing donor web from a rotating supply spool and advancing said donor web to a print zone at which said web is acted upon by a thermal print head and print drum to transfer dye from the web to a receiving medium;

advancing said donor web from the print zone toward a take-up spool at a first rate by controllably rotating said print drum by a motor means;

winding up the advanced donor web on the take-up spool by rotatably driving the take-up spool by said motor means;

interposing a capstan roller between said print drum and said take-up spool; and drivingly engaging said donor web and controllably advancing said donor web towards said take-up spool at a second rate not exceeding said first rate as said web is paid out of said print zone at said first rate, to thereby eliminate tension on said donor web caused by said take-up spool as said donor web exits said print zone.

4. A method, as set forth in claim 3, including the step of advancing said web with said capstan roller at said second rate as said web is paid out of said print zone at said first rate, where said second rate is less than said first rate, and accumulating an amount of slack in said web.

5. A method, as set forth in claim 3, including the steps of:

delaying operation of said capstan roller and accumulating an amount of slack in said web; and advancing said web with said capstan roller at said second rate as said web is paid out of said print zone at said first rate, where said second rate is the same as said first rate, while retaining an amount of said slack.

* * * * *